US008444375B2

(12) United States Patent
Naik et al.

(10) Patent No.: US 8,444,375 B2
(45) Date of Patent: May 21, 2013

(54) COOLED BLADE FOR A GAS TURBINE, METHOD FOR PRODUCING SUCH A BLADE, AND GAS TURBINE HAVING SUCH A BLADE

(75) Inventors: Shailendra Naik, Gebenstorf (CH); Gaurav Pathak, Ennetbaden (CH)

(73) Assignee: Alstom Technology Ltd, Baden (CH)

( * ) Notice: Subject to any disclaimer, the term of this patent is extended or adjusted under 35 U.S.C. 154(b) by 26 days.

(21) Appl. No.: 13/095,427

(22) Filed: Apr. 27, 2011

(65) Prior Publication Data

US 2011/0243755 A1 Oct. 6, 2011

Related U.S. Application Data

(63) Continuation of application No. PCT/EP2009/063388, filed on Oct. 14, 2009.

(30) Foreign Application Priority Data

Oct. 27, 2008 (EP) ..... 08167661

(51) Int. Cl.
*F01D 5/18* (2006.01)

(52) U.S. Cl.
USPC ..... 415/115; 416/97 R

(58) Field of Classification Search
USPC ..... 415/115; 416/90 R, 92, 96 R, 96 A, 416/97 R, 193 A; 29/889.721; 219/69.17, 219/121.71
See application file for complete search history.

(56) References Cited

U.S. PATENT DOCUMENTS

| | | | | |
|---|---|---|---|---|
| 6,102,658 | A * | 8/2000 | Kvasnak et al. | 416/97 R |
| 6,190,130 | B1 | 2/2001 | Fukue et al. | |
| 6,558,114 | B1 * | 5/2003 | Tapley et al. | 415/115 |
| 7,520,724 | B2 | 4/2009 | Naik et al. | |
| 2003/0108422 | A1 | 6/2003 | Merry | |

(Continued)

FOREIGN PATENT DOCUMENTS

| | | |
|---|---|---|
| EP | 0 940 561 A | 9/1999 |
| EP | 1 319 803 A | 6/2003 |

(Continued)

OTHER PUBLICATIONS

International Search Report (PCT/ISA/210) issued on Jan. 28, 2010, by European Patent Office as the International Searching Authority for International Application No. PCT/EP2009/063388.

(Continued)

*Primary Examiner* — Christopher Verdier
(74) *Attorney, Agent, or Firm* — Buchanan Ingersoll & Rooney PC

(57) ABSTRACT

A blade for a gas turbine includes an airfoil extending in radial direction of the turbine or longitudinal direction of the blade, respectively, between a platform and a blade tip. The airfoil is bordered across the airfoil by a leading edge and a trailing edge and has a suction side and a pressure side. At the trailing edge a first cooling passage runs parallel to the trailing edge from the platform to the blade tip in the interior of the airfoil. The cooling passage is supplied with a cooling air flow from the platform side, and from which cooling air is discharged through a plurality of cooling holes arranged all over the blade. For such a blade the cooling is optimized by providing a first cooling passage, the passage area of which is tapered in radial direction by between 35% and 59%.

19 Claims, 3 Drawing Sheets

U.S. PATENT DOCUMENTS

| | | | | |
|---|---|---|---|---|
| 2004/0151586 | A1 | 8/2004 | Chlus et al. | |
| 2005/0095128 | A1 * | 5/2005 | Benjamin et al. | 416/97 R |
| 2006/0280607 | A1 | 12/2006 | Harvey et al. | |
| 2008/0050242 | A1 | 2/2008 | Liang | |

FOREIGN PATENT DOCUMENTS

| | | | |
|---|---|---|---|
| EP | 1 443 178 | A | 8/2004 |
| EP | 1 630 352 | A | 3/2006 |
| WO | WO 2005/068783 | A1 | 7/2005 |

OTHER PUBLICATIONS

Written Opinion (PCT/ISA/237) issued on Jan. 28, 2010, by European Patent Office as the International Searching Authority for International Application No. PCT/EP2009/063388.

Search Report issued on Mar. 11, 2009, by European Patent Office for Application No. 08167661.1.

* cited by examiner

FIG. 2a
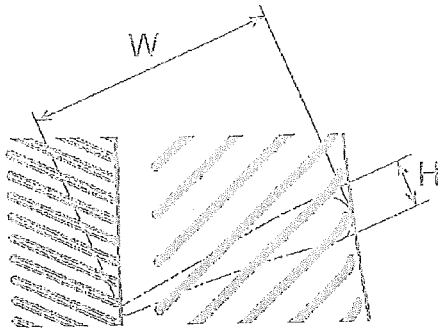
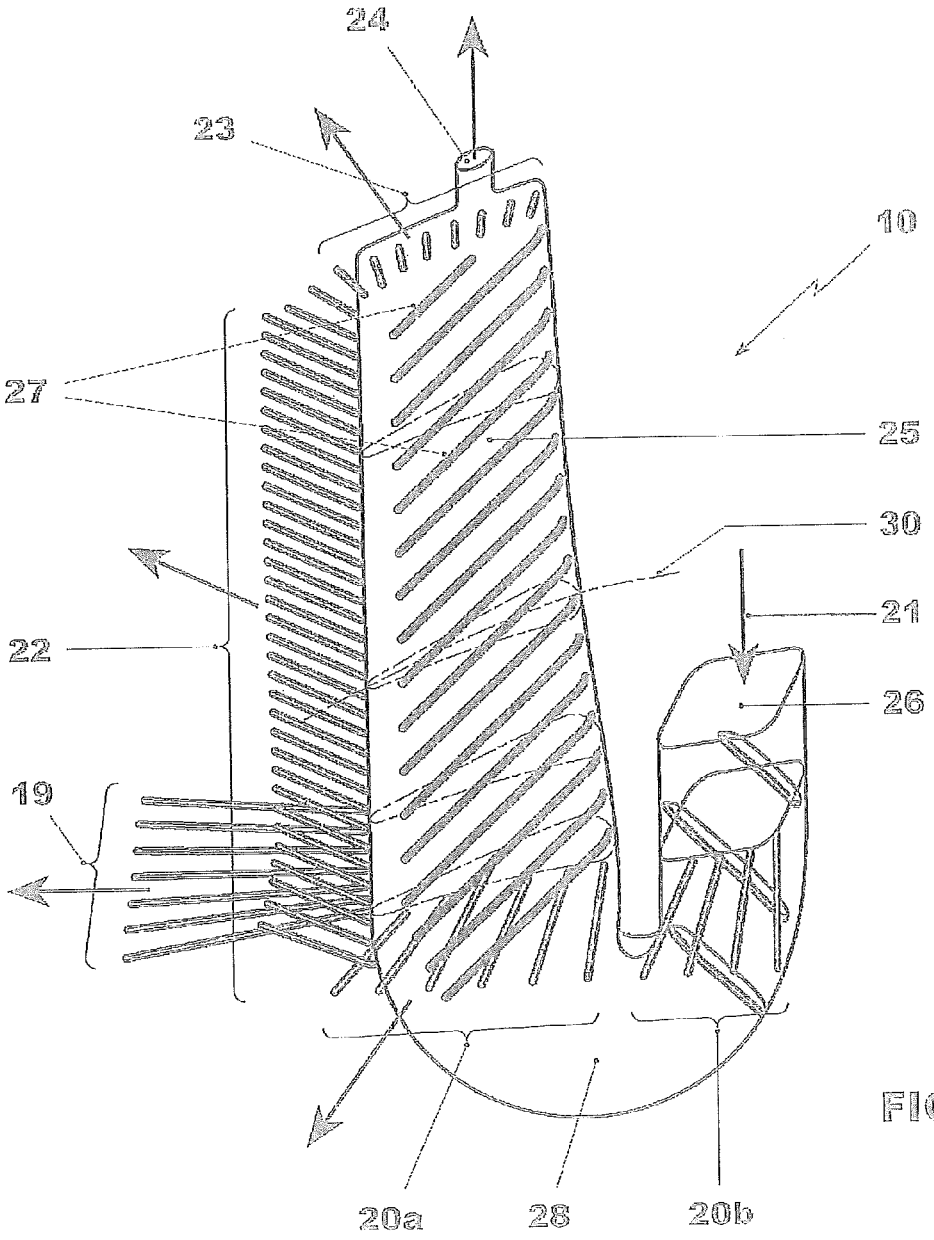
FIG. 2

COOLED BLADE FOR A GAS TURBINE, METHOD FOR PRODUCING SUCH A BLADE, AND GAS TURBINE HAVING SUCH A BLADE

RELATED APPLICATION

This application claims priority as a continuation application under 35 U.S.C. §120 to PCT/EP2009/063388, which was filed as an International Application on Oct. 14, 2009, designating the U.S., and which claims priority to European Application 08167661.1 filed in Europe on Oct. 27, 2008. The entire contents of these applications are hereby incorporated by reference in their entireties.

FIELD

The present disclosure relates to the field of gas turbines, such as a cooled blade for a gas turbine and a method for producing such a blade.

BACKGROUND INFORMATION

The efficiency of gas turbines can depend substantially on the temperature of hot gas that expands in a turbine while performing work. In order to increase efficiency, components (guide vanes, moving blades, heat accumulating segments etc.) exposed to the hot gas can be produced from heat resistant materials and can be cooled as effectively as possible during operation. Different methods have been developed in relation to the cooling of blades, and these can be used alternatively or cumulatively.

One known method includes conducting a coolant, such as pressurized cooling air from the compressor of the gas turbine, in cooling ducts through an interior of the blades. This coolant is allowed to enter into the cooling duct through cooling bores arranged in a distributed fashion. The cooling ducts can be repeatedly reversed in the interior of the blade in a serpentine fashion. See, for example, WO A1 2005/068783. The heat transfer between the coolant and walls of the blade can be improved in this case by additional turbulence generated in the coolant flow by suitable cooling elements, for example turbulators, or impingement cooling. However, complementary methods can permit the coolant to emerge from the interior of the blade such that there is formed on the blade surface a film of coolant, known as film cooling, that provides the blades additional protection against thermal loads.

Particular attention can be paid to the cooling of a narrow trailing edge of the blade. It can be advantageous for the efficiency of the turbine if the trailing edge can be designed to be as thin as possible. The trailing edge should be adequately cooled. Moreover, it can be advantageous to have cooling that is uniform in all operating states. It can be advantageous that the use of coolant be restricted to what is required in order not to exert a disadvantageous influence on the efficiency of the machine.

SUMMARY

A blade for a gas turbine is disclosed, including a platform, a blade tip, a leading edge, a trailing edge, and an airfoil extending between the platform and the blade tip, the airfoil being bounded in at least one direction by the leading edge and the trailing edge and having a suction side and a pressure side, wherein in a region of the trailing edge and in a direction running parallel to the trailing edge from the platform up to the blade tip, in an interior of the airfoil, there is a first cooling duct for feeding a coolant flow from the platform and from which coolant is guided to an outside of the airfoil via a multiplicity of holes arranged distributed on the blade, wherein a cross section of the first cooling duct tapers toward the blade tip, the taper being between 35% and 59%.

A method for producing a blade for a gas turbine, including forming a blade which includes a platform, a blade tip, a leading edge, a trailing edge, and an airfoil extending between the platform and the blade tip, the airfoil being bounded in at least one direction by the leading edge and the trailing edge and having a suction side and a pressure side, wherein in a region of the trailing edge and in a direction running parallel to the trailing edge from the platform up to the blade tip in an interior of the airfoil, there is a first cooling duct for feeding a coolant flow from the platform and from which coolant is guided to an outside of the airfoil via a multiplicity of holes arranged distributed on the blade, and wherein a cross section of the first cooling duct tapers toward the blade tip, the taper being between 35% and 59%, and forming the holes on the blade from outside into the blade as cooling bores with specified geometric tolerance by at least one of EDM (Electro-Discharge Machining) or laser drilling.

BRIEF DESCRIPTION OF THE DRAWINGS

The disclosure is explained in more detail below with the aid of exemplary embodiments in conjunction with the drawings. All elements that are not essential for directly understanding the disclosure have been omitted. Identical elements are provided with identical reference numerals in the various figures. The flow direction of the media is specified by arrows. In the drawings:

FIG. 2 shows the cooling duct running parallel to the trailing edge, together with the cooling bores emanating therefrom from FIG. 1;

FIG. 2*a* shows an enlarged section from FIG. 2 for the purpose of explaining the cross sectional dimensions in the cooling duct.

DETAILED DESCRIPTION

Figure 1:
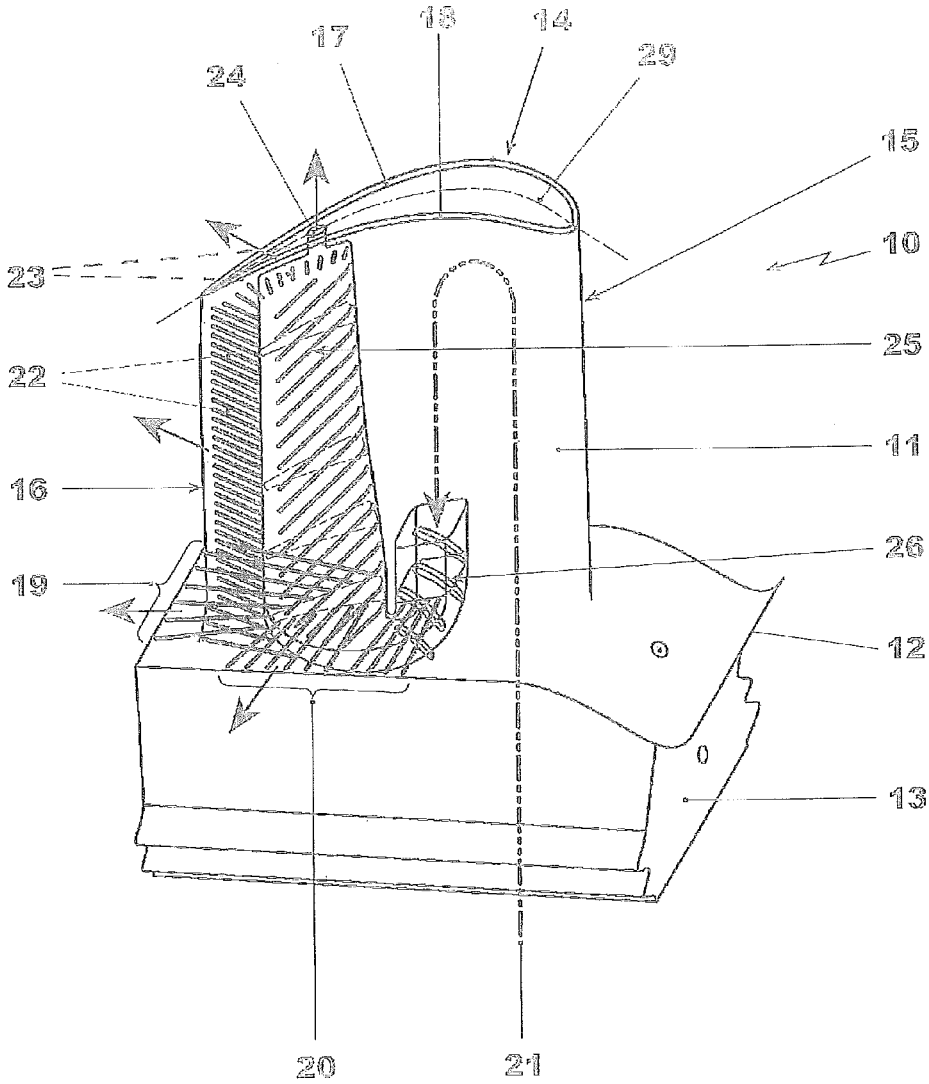
FIG. 1 shows a perspective, simplified illustration of a cooled gas turbine blade in accordance with an exemplary embodiment of the disclosure, only the cooling bores arranged distributed in the region of the trailing edge being shown.
Figure 3:
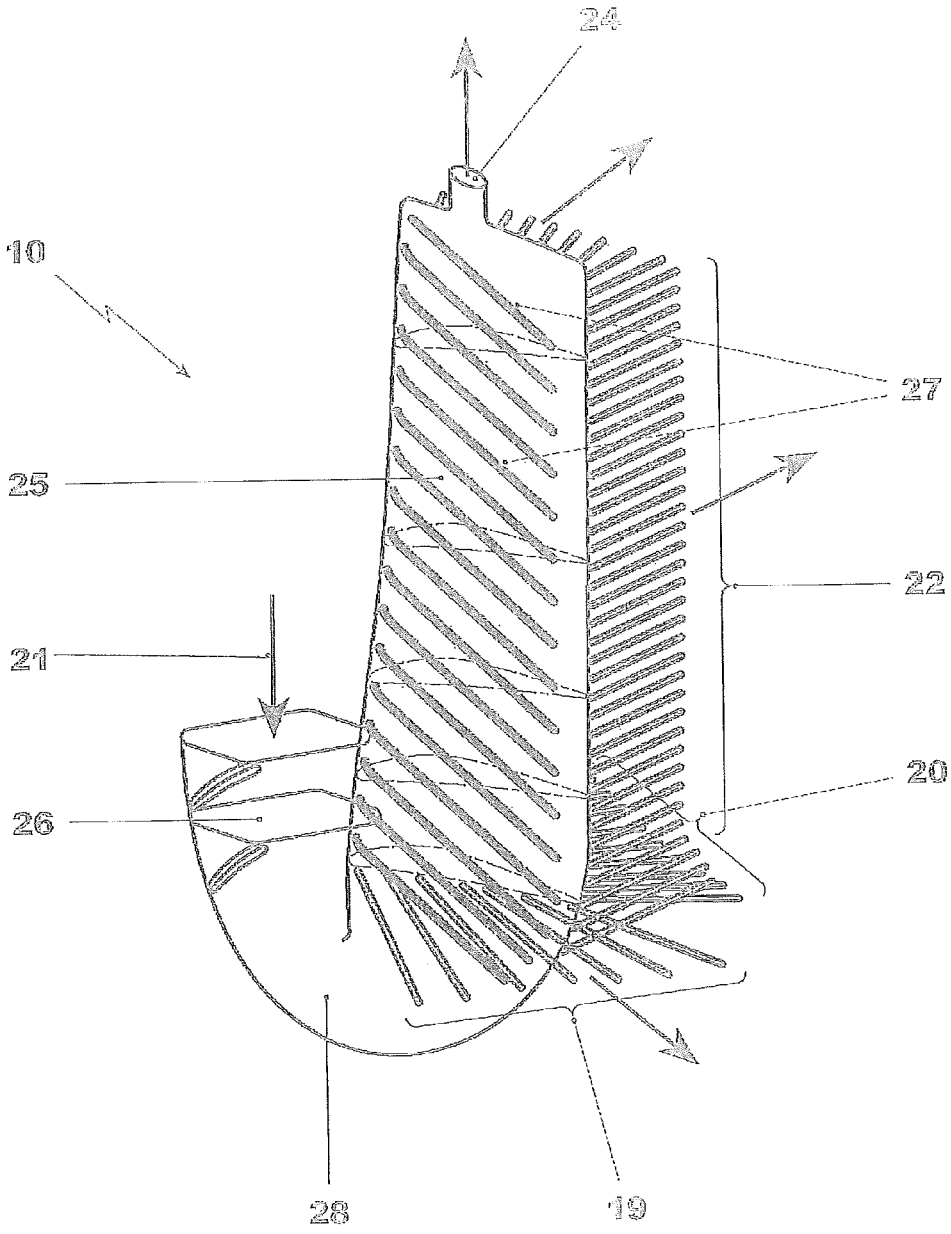
FIG. 3 shows, in an illustration comparable to FIG. 2, the configuration being composed of cooling duct and cooling bores as seen from another side.

The disclosure relates to a cooled blade for a gas turbine which is distinguished by improved cooling, and a method for producing it. It can be advantageous that in a region of a trailing edge of a blade, and running parallel to the trailing edge from a platform up to a blade tip in an interior of an airfoil, there is a first cooling duct to which a coolant flow is supplied from the platform and from which coolant is guided to an outside via a multiplicity of holes distributed on the blade. The cross section of the first cooling duct tapers toward the blade tip, the taper being between, for example, 35% and 59%. For example, the taper of the blade can be approximately 42% (e.g., ±10%).

In an exemplary embodiment of the disclosure, a cross-sectional area of the first cooling duct has a height in a circumferential direction of the turbine, and a width in an axial direction of the turbine. The height/width side ratio diminishes toward the blade tip. The height/width side ratio diminishes toward the blade tip at, for example, 5% to 14%; for example, the height/width side ratio diminishes toward the blade tip by approximately 9%.

The holes arranged distributed on the blade can be designed as elongated cooling bores that can be produced with low geometric tolerance, for example, by EDM (Electro-Discharge Machining) or laser drilling.

In another exemplary embodiment of the disclosure, first cooling bores can be arranged distributed along the trailing edge. Second cooling bores can be arranged distributed on the blade tip, and the first and second cooling bores open into the exterior on a pressure side of the blade or have been introduced into the blade from the pressure side.

The inlets of the first cooling bores can be arranged substantively on a centerline of the first cooling duct.

The first cooling bores can have a cylindrical shape in that the ratio of a length to diameter of the first cooling bores can be between, for example, 20 and 35. The spacing of neighboring first cooling bores in a radial direction can be, for example, 2 to 5 times, for example, 3.5 times their diameter. The first cooling bores can enclose with the horizontal an angle of, for example, 20°-40°; for example, approximately 30°. The angle of the first cooling bores to the surface of the blade can be between, for example, 8° and 15°; for example, approximately 10°.

In accordance with an exemplary embodiment of the disclosure, at the transition between the platform and airfoil, the first cooling bores can be aligned with the centerline of the airfoil such that the coolant air is ejected centrally through these cooling bores at the intersection point between the centerline and the profile of the trailing edge.

In an exemplary embodiment the first cooling bores can merge uniformly at the blade tip into the second cooling bores. The second cooling bores can have a cylindrical shape. The ratio of length to diameter of the second cooling bores can be between, for example, 4 and 15. The spacing of neighboring second cooling bores can be, for example, 4 to 6 times; for example, 5 times their diameter. The angle of the second cooling bores to the surface of the blade can be between, for example, 25° and 35°; for example, approximately 30°.

In an exemplary embodiment for the cooling of the blades, third and fourth cooling bores can run through the platform, and the third cooling bores open into an exterior on a suction side of the blade, and the fourth cooling bores open into the exterior on the pressure side of the blade.

The fourth cooling bores can have a cylindrical shape and enclose different angles with the edge of the platform. The spacing of neighboring fourth cooling bores on the outside of the platform can be, for example, 5 to 8 times; for example, approximately 6 times their diameter. The ratio of length to diameter of the fourth cooling bores can be between, for example, 25 and 35. A proportion of the fourth cooling bores exit from the first cooling channel on its side facing the pressure side of the blade.

The third cooling bores can have a cylindrical shape and enclose different angles with the edge of the platform. The spacing on neighboring third cooling bores on the outside of the platform can be, for example, 6 to 8 times; for example, approximately 6.5 times their diameter. The ratio of length to diameter of the third cooling bores can be between, for example, 30 and 45. The third cooling bores can emerge from the first cooling duct on its side facing the suction side of the blade.

In order to generate and/or reinforce a turbulent cooling air flow, obliquely positioned ribs can be arranged in the first cooling duct. In the region of the platform, the first cooling duct can be connected via a bend to a parallel running second cooling duct. An outwardly guiding particle hole of relatively large diameter can be provided in the blade tip at the end of the first cooling duct.

In an exemplary embodiment of a method for producing the blade, holes arranged distributed on the blade are introduced from outside into the blade in the form of cooling bores with low geometric tolerance by, for example, EDM (Electro-Discharge Machining) or laser drilling.

The disclosure can be applied advantageously in a gas turbine having a multiplicity of moving blades fitted on a rotor and of guide vanes fitted in the housing surrounding the rotor. This can be done by using blades according to the disclosure as moving blades and/or guide blades.

FIG. 1 shows a perspective, simplified illustration of a cooled gas turbine blade in accordance with an exemplary embodiment of the disclosure. The blade 10, which can be a moving blade rotating with the rotor about the machine axis, or a guide blade mounted in stationary fashion on the housing, includes an airfoil 11 that extends in a longitudinal direction of the blade or in a radial direction of the gas turbine and terminates at the free end in a blade tip 14. Adjoining the other end of the airfoil 11 is a platform 12 that bounds the hot gas duct and below which there is integrally formed a blade root 13 for mounting the blade 10 in a groove, provided for the purpose, in the rotor. The airfoil is bounded in the direction transverse to the longitudinal axis, that is to say in the flow direction of the hot gas of the turbine, upstream by a leading edge 15, and downstream by a trailing edge 16. The airfoil 11 has a cross sectional profile of a wing, the convexly curved side being the suction side 17 and the concavely curved side being the pressure side 18.

In an interior a number of cooling ducts are provided that run parallel in the longitudinal direction, and are connected in a serpentine fashion. The figures show only a last cooling duct 25, arranged in the region of a trailing edge 16, and a portion of a cooling duct 26 arranged upstream thereof (FIG. 2). The two cooling ducts 25 and 26 can be interconnected by a bend 28 conforming to the flow (FIG. 2). In order to cool the blade 10, there can be applied to the cooling ducts 25, 26 a cooling air flow 21 that (as indicated by a dashed and dotted arrow in FIG. 1) can be guided up from below through the blade root 13 and the platform 12 from a plenum with compressed air of the gas turbine.

The trailing edge 16, the platform 12 and the blade tip 14 of the blade can be penetrated by a multiplicity of long cooling bores 19, 20, 22 and 23 through which cooling air moves outward out of the cooling ducts 25, 26, and in the process cools the regions of the blade 10 which are flowed through. The cooling bores 19, 20, 22 and 23 can be produced, for example, by EDM (Electro-Discharge Machining; spark erosion) and/or laser drilling, it thereby being possible to effect narrow geometric tolerances in the bores.

All the cooling bores 22 and 23 of the airfoil 11 and of the blade tip 14 can open outward on the pressure side 18 of the blade 10. The cooling bores 19 and 20 and 20*a, b* running through the platform 12 can open into the exterior on the suction side 17 of the blade (cooling bores 19) or on the pressure side 18 of the blade (cooling bores 20 and 20*a, b*). All the cooling bores of the cooling channels 25 (cooling bores 19, 20*a*, 22, 23) and 26 (cooling bores 20*b*) can emerge in the interior of the blade 10.

In order to permit the cooling air guided in the cooling ducts 25, 26 to emerge at predetermined rates through all the cooling bores 19, 20, 22, 23 on the trailing edge 16, the blade tip 14 and the platform 12, the cooling duct 25 at the trailing edge can be dimensional with regard to flow cross section and side ratio (H/W in FIG. 2*a*). This can ensure that the cooling air pressure in the cooling duct 25 assumes and maintains a predetermined value in all operating states of the machine. In particular, the dependence of the flow cross sections and side ratios in the cooling ducts 25 on the blade height (spatial coordinates in blade longitudinal direction) is arranged. The flow cross section of the cooling duct 25 can taper conically toward the blade tip 14, by, for example, 35% to 59%; for example, approximately 42%. The ratio H/W of duct height H in a circumferential direction and duct width W in an axial direction (see FIG. 2*a*) can diminish toward the blade tip 14 by, for example, 5% to 40%; for example, by approximately 9%.

The first cooling bores 22 of the blade 10 can be introduced into the airfoil 11 from the pressure side 18. They open in the interior of the blade 10 into the cooling duct 25, specifically such that their holes can lie directly on the centerline (dashed and dotted line 30 in FIG. 2) of the cooling duct cross section.

The first cooling bores 22 can be aligned in this case such that they enclose an angle between, for example, 20° and 40°; for example, approximately 30° with the horizontal. The angle between the first cooling bores 22 and the surface of the airfoil 11 can be between, for example, 8° and 15°; for example, approximately 10°. The spacing between neighboring first cooling bores 22 in a radial direction can correspond to 2 to 5 times, for example, approximately 3.5 times the bore diameter. The ratio of the length of the first cooling bores 22 to the diameter can vary along the blade heights in the region between 20 and 35. The first cooling bores 22 can all have a cylindrical shape.

At the transition between the platform 12 and the airfoil (at the lower end of the cooling duct 25 at the transition to the bend 28), the first cooling bores 22 there can be aligned along or substantially along the chord line 29 of the airfoil 11 (dashed and dotted line in FIG. 1) such that the cooling air can be ejected centrally through these first cooling bores 22 at the intersection point between the chord line 29 and the profile of the trailing edge 16.

The first cooling bores 22 can merge uniformly into shorter second cooling bores 23 on the blade tip 14. The second cooling bores 23 can have a cylindrical shape. The ratio of length to diameter of the second cooling bores 23 can be between, for example, 4 and 15. The spacing of neighboring second cooling bores 23 can be, for example, 4 to 6 times; for example, 5 times their diameter. The angle of the second cooling bores 23 to the surface of the blade 10 can be between, for example, 25° and 35°, for example; approximately 30°.

As described above, third and fourth cooling bores 19 and 20, 20*a, b* run through the platform 12, the third cooling bores 19 open into the exterior on the suction side 17 of the blade 10, and the fourth cooling bores 20, 20*a, b* open into the exterior on the pressure side 18 of the blade 10. The fourth cooling bores 20, 20*a, b* also have a cylindrical shape. They enclose various angles with the edge of the platform 12 (spreading). The spacing on neighboring fourth cooling bores 20; 20*a, b* on the outside of the platform 12 is, for example, 5 to 8 times; for example, approximately 6 times their diameter. The ratio of length to diameter of the fourth cooling bores 20, 20*a, b* is between, for example, 25 and 35. A proportion (20*a*) of the fourth cooling bores can exit from the first cooling channel 25 on its side facing the pressure side 18 of the blade 10. Another portion (20*b*) can exit from the second cooling duct 26 at its side facing the pressure side 18 of the blade 10.

The third cooling bores 19 can also have a cylindrical shape and enclose different angles with the edge of the platform 12. The spacing of neighboring third cooling bores 19 on the outside of the platform 12 is, for example, 6 to 8 times; for example, approximately 6.5 times their diameter. A ratio of length to diameter of the third cooling bores 19 lies between, for example, 30 and 45. The third cooling bores 19 can exit from the first cooling duct 25 at its side facing the suction side 17 of the blade 10.

In order to generate and/or reinforce a turbulent cooling air flow, obliquely positioned ribs 27 can be arranged in the first cooling duct 25. It is possible to provide in the blade tip 14, at the end of the first cooling duct 25, a dust hole 24 of larger diameter that leads outward and is known per se, for example, from EP A2 1 882 817 and can contribute to preventing accumulation of dust in the cooling duct 25.

Thus, it will be appreciated by those having ordinary skill in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE NUMERALS

10 Blade (gas turbine)
11 Airfoil
12 Platform
13 Blade root
14 Blade tip
15 Leading edge
16 Trailing edge
17 Suction side
18 Pressure side
19, 20, 20*a,b* Cooling hole
22, 23 Cooling hole
21 Cooling air flow
24 Dust hole
25,26 Cooling passage
27 Rib
28 Bend
29 Chord line (airfoil)
30 Centerline (cooling passage 25)

What is claimed is:

1. A blade for a gas turbine, comprising:

a platform;

a blade tip;

a leading edge;

a trailing edge; and an airfoil extending between the platform and the blade tip, the airfoil being bounded in at least one direction, by the leading edge and the trailing edge and having a suction side and a pressure side, wherein in a region of the trailing edge and in a direction running parallel to the trailing edge from the platform up to the blade tip, in an interior of the airfoil, there is a first cooling duct for feeding a coolant flow from the platform and from which coolant is guided to an outside of the airfoil via a multiplicity of holes arranged distributed on the blade, wherein a flow cross section of the first cooling duct tapers toward the blade tip from the platform, the taper being between 35% and 59%, wherein the holes arranged distributed on the blade are elongated cooling bores produced with low geometric tolerance by at least one of Electro-Discharge Machining and laser drilling; the elongated cooling bores including first cooling bores arranged distributed along the trailing edge; and second cooling bores arranged distributed on the blade tip, wherein the first and second cooling bores open into an exterior on the pressure side of the blade or have been introduced into the blade from the pressure side, wherein the first cooling bores have a cylindrical shape, a ratio of a length to a diameter of the first cooling bores is between 20 and 35, a spacing of neighboring first cooling bores in a radial direction is 2 to 5 times their diameter, the first cooling bores enclose with a horizontal an angle of 20°-40°, and an angle of the first cooling bores to a surface of the blade is between 8° and 15°.

2. The blade as claimed in claim 1, wherein the airfoil is configured to extend in either a radial direction of a gas turbine or in a longitudinal direction of a blade when installed, and wherein the taper is approximately 42%.

3. The blade as claimed in claim 1, wherein a cross-sectional area of the first cooling duct has a height (H) in a circumferential direction of a gas turbine in which the blade is to be installed, and a width (W) in an axial direction of the gas turbine, and wherein the height/width (H/W) side ratio diminishes toward the blade tip.

4. The blade as claimed in claim 3, wherein the height/width (H/W) side ratio diminishes toward the blade tip by 5% to 14%.

5. The blade as claimed in claim 3, wherein the height/width (H/W) side ratio diminishes toward the blade tip by approximately 9%.

6. The blade as claimed in claim 1, wherein inlets of the first cooling bores are arranged on a centerline of the first cooling duct.

7. The blade as claimed in claim 1, wherein at a transition between the platform and the airfoil, the first cooling bores are aligned with a chord line of the airfoil such that the cooling air is ejected centrally through these cooling bores at an intersection point between the chord line and a profile of the trailing edge.

8. The blade as claimed in claim 1, wherein the first cooling bores merge uniformly at the blade tip into the second cooling bores, the second cooling bores have a cylindrical shape, a ratio of length to diameter of the second cooling bores is between 4 and 15, a spacing of neighboring second cooling bores is 4 to 6 times their diameter, and an angle of the second cooling bores to a surface of the blade is between 25° and 35°.

9. The blade as claimed in claim 1, wherein third and fourth cooling bores run through the platform, and the third cooling bores open into an exterior on the suction side of the blade, and the fourth cooling bores open into the exterior on the pressure side of the blade.

10. The blade as claimed in claim 9, wherein the fourth cooling bores have a cylindrical shape and enclose different angles with an edge of the platform, and wherein a spacing of neighboring fourth cooling bores on an outside of the platform is 5 to 8 times their diameter, and wherein a ratio of length to diameter of the fourth cooling bores is between 25 and 35.

11. The blade as claimed in claim 10, wherein a proportion of the fourth cooling bores exit from the first cooling channel on a side of the first cooling channel facing the pressure side of the blade.

12. The blade as claimed in claim 9, wherein the third cooling bores have a cylindrical shape and enclose different angles with an edge of the platform, and a spacing of neighboring third cooling bores on an outside of the platform is 6 to 8 times their diameter, and wherein a ratio of length to diameter of the third cooling bores is between 30 and 45.

13. The blade as claimed in claim 12, wherein the third cooling bores emerge from the first cooling duct on a side of the first cooling duct facing the suction side of the blade.

14. The blade as claimed in claim 9, wherein the fourth cooling bores have a cylindrical shape and enclose different angles with an edge of the platform, and wherein a spacing of neighboring fourth cooling bores on an outside of the platform is 6 times their diameter, and a ratio of length to diameter of the fourth cooling bores is between 25 and 35.

15. The blade as claimed in claim 9, wherein the third cooling bores have a cylindrical shape and enclose different angles with the edge of the platform, and a spacing of neighboring third cooling bores on the outside of the platform is approximately 6.5 times their diameter, and a ratio of length to diameter of the third cooling bores is between 30 and 45.

16. The blade as claimed in claim 1, comprising:

obliquely positioned ribs arranged in the first cooling duct in order to at least one of generate and reinforce a turbulent cooling air flow, wherein in a region of the platform, the first cooling duct is connected via a bend to a parallel running second cooling duct; and an outwardly guiding dust hole of relatively large diameter provided in the blade tip at the end of the first cooling duct.

17. The blade of claim 1, in combination with a gas turbine having a plurality of moving blades fitted on a rotor, and guide blades fitted in a housing surrounding the rotor, wherein the blade is used as at least one of the moving blades and the guide blades.

18. The blade as claimed in claim 1, wherein the spacing of neighboring first cooling bores in a radial direction is approximately 3.5 times their diameter, the first cooling bores enclose with the horizontal an angle of approximately 30°, and the angle of the first cooling bores to a surface of the blade is approximately 10°.

19. The blade as claimed in claim 1, wherein the first cooling bores merge uniformly at the blade tip into the second cooling bores, the second cooling bores have a cylindrical shape, a ratio of length to diameter of the second cooling bores is between 4 and 15, the spacing of neighboring second cooling bores is 5 times their diameter, and an angle of the second cooling bores to the surface of the blade is approximately 30°.

* * * * *